US005913304A

United States Patent [19]

Johnson

[11] Patent Number: 5,913,304

[45] Date of Patent: Jun. 22, 1999

[54] COMPRESSED AIR GUN WITH TEMPORARY SEAL

[75] Inventor: Lonnie G. Johnson, Smyrna, Ga.

[73] Assignee: Johnson Research & Development Co., Inc., Smyrna, Ga.

[21] Appl. No.: 08/863,289

[22] Filed: May 27, 1997

[51] Int. Cl.[6] ..... F41B 11/00

[52] U.S. Cl. ..... 124/59; 124/69; 124/70; 124/72; 124/48

[58] Field of Search ..... 124/59, 69, 70, 124/72, 73, 48

[56] References Cited

U.S. PATENT DOCUMENTS

| | | | |
|---|---|---|---|
| 2,147,003 | 2/1939 | Von Kozurik | 124/11 |
| 2,312,244 | 2/1943 | Feltman | 124/11 |
| 2,357,951 | 9/1944 | Hale | 124/11 |
| 2,654,973 | 10/1953 | Lemelson | 46/56 |
| 2,733,699 | 2/1956 | Krinsky | 124/13 |
| 2,927,398 | 3/1960 | Kaye et al. | 46/74 |
| 2,962,017 | 11/1960 | Horowitz et al. | 124/27 |
| 3,025,633 | 3/1962 | Kaye et al. | 46/74 |
| 3,121,292 | 2/1964 | Butler et al. | 46/74 |
| 3,397,476 | 8/1968 | Weber | 43/6 |
| 3,612,026 | 10/1971 | Vadas et al. | 124/11 |
| 3,962,818 | 6/1976 | Pippin | 46/74 |
| 4,073,280 | 2/1978 | Koehn | 124/72 |
| 4,083,349 | 4/1978 | Clifford | 124/72 |
| 4,159,705 | 7/1979 | Jacoby | 124/63 |
| 4,223,472 | 9/1980 | Feket et al. | 46/44 |
| 4,411,249 | 10/1983 | Fogarty et al. | 124/64 |
| 4,890,767 | 1/1990 | Burlison | 222/78 |
| 4,897,065 | 1/1990 | Fertig et al. | 446/63 |
| 5,090,708 | 2/1992 | Gerlitz et al. | 273/310 |
| 5,186,156 | 2/1993 | Clayton | 124/59 |
| 5,188,557 | 2/1993 | Brown | 446/212 |
| 5,280,917 | 1/1994 | Ortiz | 273/318 |
| 5,343,849 | 9/1994 | Steer | 124/72 |
| 5,343,850 | 9/1994 | Steer | 124/64 |
| 5,370,278 | 12/1994 | Raynie | 222/175 |
| 5,373,832 | 12/1994 | D'Andrade | 124/69 |
| 5,415,152 | 5/1995 | Adamson et al. | 124/59 |
| 5,535,729 | 7/1996 | Griffin et al. | 124/59 |
| 5,553,598 | 9/1996 | Johnson et al. | 124/69 |
| 5,613,483 | 3/1997 | Lukas et al. | 124/73 |
| 5,660,159 | 8/1997 | Clayton | 124/59 |
| 5,680,853 | 10/1997 | Clayton | 124/59 |
| 5,797,385 | 8/1998 | Thai | 124/59 |

FOREIGN PATENT DOCUMENTS

2587911-A1 10/1985 France .

*Primary Examiner*—J. Woodrow Eldred
*Attorney, Agent, or Firm*—Kennedy, Davis & Kennedy P.C.

[57] ABSTRACT

An air compressed gun (10) is provided having a pressure chamber (35), a moveable magazine (18) and a conduit conveying pressurized air from the pressure chamber to the magazine. The conduit has a resilient sealing gasket (42) which is reconfigurable between a relaxed configuration and an expanded configuration with the presence of pressurized air.

29 Claims, 8 Drawing Sheets

COMPRESSED AIR GUN WITH TEMPORARY SEAL

TECHNICAL FIELD

This invention relates to compressed air guns, and specifically to compressed air toy guns having a multi-projectile magazine.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in sequence. The sequential firing of a gun may be desired for those playing a mock war or other type of competition. Guns which may fire several darts in sequence typically have a moveable magazine which contains several darts. However, because the magazine is movable it is very difficult to create a seal between the conduit conveying compressed air to the magazine and the magazine itself.

Compressed air guns have been designed with O-ring type seals between the conduit and magazine. However, this type of seal is maintained in contact with the magazine as the magazine rotates or otherwise moves in indexing the projectiles therein. This movement of the magazine against the seal causes rapid wear which destroys the seal and thus causes an air leak which drastically decreases the guns efficiency.

Compressed air guns have also been designed which have spring biased couplers extending from the conduit to the magazine, as shown in U.S. Pat. No. 5,592,931. These couplers are biased so that they are continuously forced against the magazine so as to optimize their sealing capabilities. Should the coupler also include a O-ring types seal, the seal is still in contact with the magazine as it rotates and therefore still becomes worn over time. Again, this wearing will eventually destroy the sealing capabilities of the seal and cause a drastic decrease in the guns efficiency. Should the coupler not have an O-ring type seal it typically does not provide an air tight seal between the coupler and the magazine, hence they do not fully solve the sealing problem.

Accordingly, it is seen that a need remains for a toy air gun which may efficiently fire a sequence of projectiles. It is to the provision of such therefore that the present invention is primarily directed.

SUMMARY OF THE INVENTION

In a preferred form of the invention a rapid fire compressed air gun for firing projectiles comprises a launch tube adapted to hold a projectile. The launch tube has an end wall and an air opening extending through the end wall. The air gun also has an air pump adapted to compress air, a conduit in fluid communication with the air pump and the launch tube, the conduit having an exit end positioned adjacent the launch tube end wall, and a resilient seal mounted to the exit end of the conduit. The seal has an opening therethrough generally aligned with the air opening of the launch tube end wall and an outer surface facing the launch tube end wall. The seal is adapted to be moved between a relaxed position generally separated from the launch tube end wall and an expanded position wherein the outer surface is in contact with the launch tube end wall about the end wall air opening.

DETAILED DESCRIPTION

Figure 1:
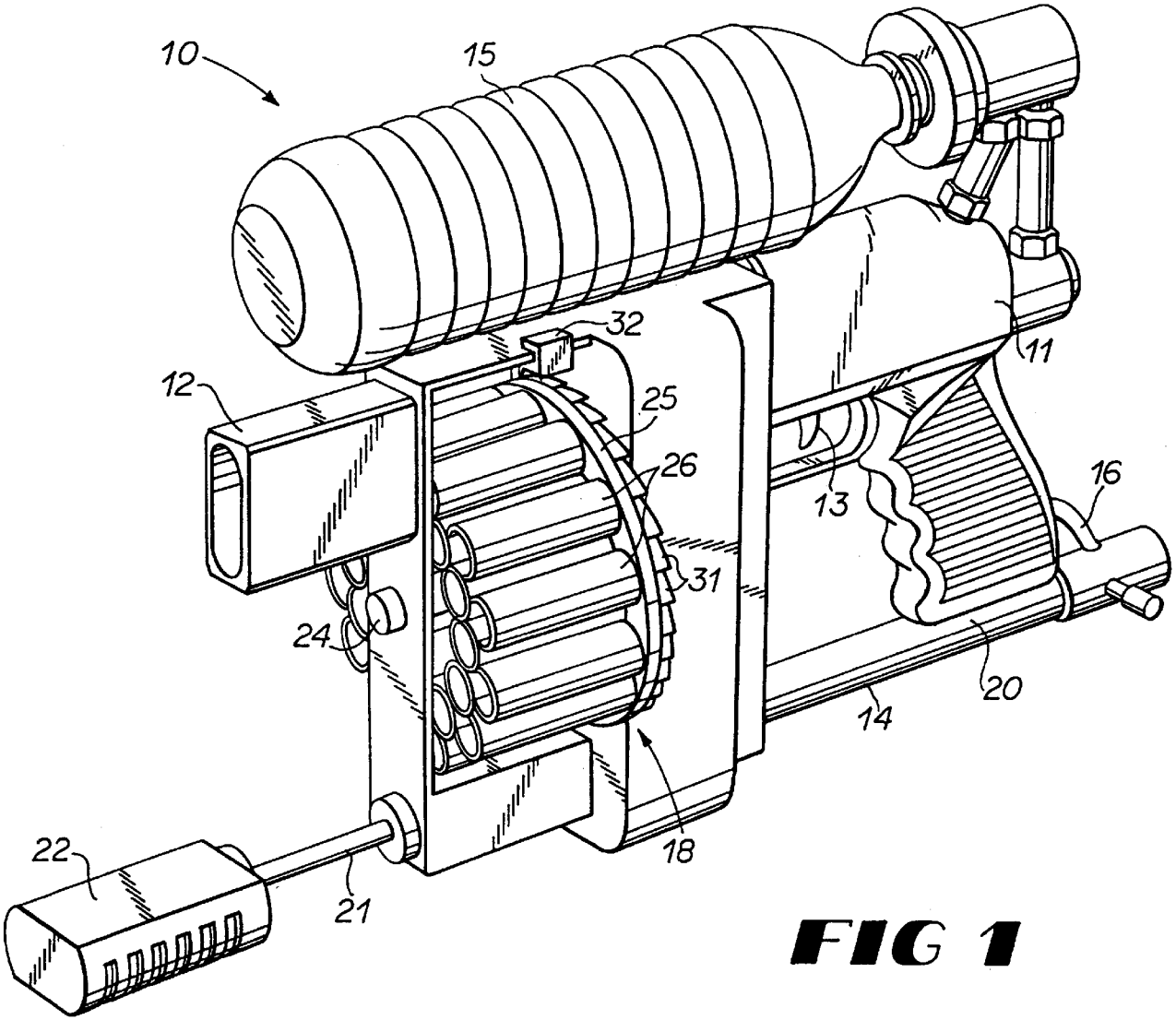
FIG. 1 is a perspective view of a rapid fire compressed air gun embodying principles of the present invention in a preferred form.

With reference next to the drawings, there is shown a compressed air gun 10 having a stock or handle 11, a barrel 12 mounted to the stock 11, a spring biased trigger 13, and a manual air pump 14. The gun 10 has a pressure tank 15 in fluid communication with the air pump 14 through a pressure tube 16 and a multi-projectile magazine 18 rotationally mounted to stock 11. The pump 14 includes a conventional cylinder 20, a cylinder rod 21 and a handle 22 mounted to an end of the cylinder rod 21.

Figure 2:
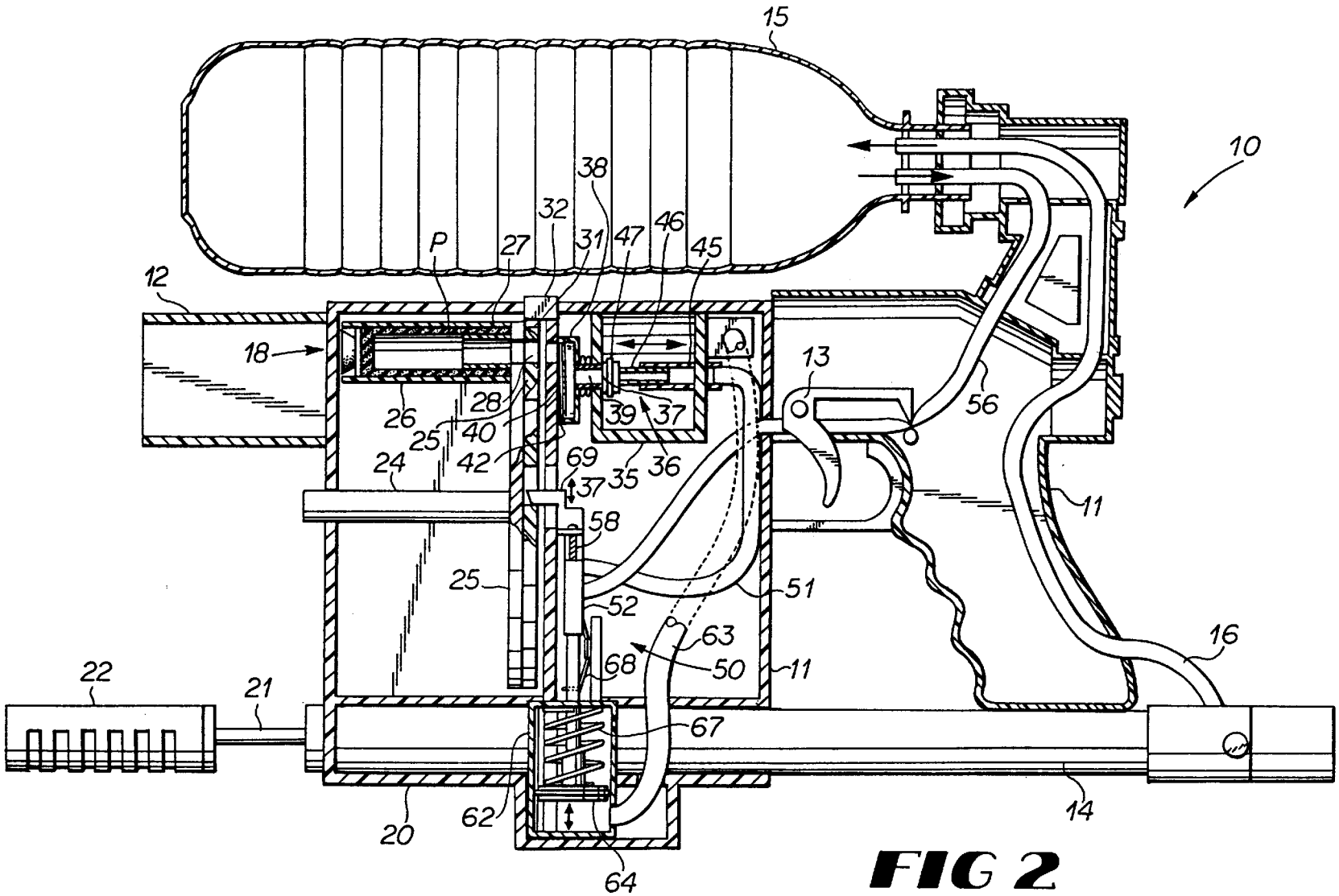
FIG. 2 is a side view, shown in partial cross-section, of the air gun of FIG. 1.

The magazine 18 has a central pivot rod 24 mounted to a disk-shaped mounting plate 25 and an annular array of projectile barrels 26 extending from the mounting plate 25 in generally two concentric circles about pivot rod 24. Each barrel 26 has a launch tube 27 therein aligned with an opening 28 extending through the mounting plate 25. The gun magazine is shown in FIG. 2 as having only one barrel for clarity of explanation. Mounting plate 25 has series of peripheral, outwardly extending, serrated teeth 31 each of which is aligned with a barrel 26. The serrated teeth 31 are configured to cooperate with a pawl 32 extending from the stock 11. The mounting plate 25 also has an annular array of L-shaped grooves 33 equal in number to the number of magazine barrels 26.

The gun 10 has a pressure chamber 35 adapted to receive and store a supply of air at elevated pressure levels and a pressure sensitive release valve 36 mounted within the pressure chamber 35. The pressure chamber 35 has an exit opening 37 therein. A conduit having a spring biased sealing plate 38 is mounted within opening 37. The sealing plate 38 has a central bore 39 extending into an elongated bore 40 configured to overlay the mounting plate openings 28. It should be noted that the mounting plate openings 28 are positioned so that the sealing plate elongated bore 40 overlaps only one opening 28 at a time. The sealing plate has a resilient gasket 42 having an upper opening 43 and a lower opening 44 therethrough. The upper opening 43 is alignable with the outer or peripheral magazine openings 28 and the lower opening 44 is alignable with the inner magazine openings 28. Gasket 42 ensures sealing engagement of the sealing plate with the magazine mounting plate 25. The release valve 36 has a cylindrical manifold 45 and a cylindrical plunger 46 slidably mounted within manifold 45. Plunger 46 has a gasket 47 to ensure sealing engagement of the plunger about opening 37.

The release valve manifold 45 is pneumatically coupled to an actuator 50, by a pressure tube 51 extending therebetween the actuator 50 automatically and sequentially causes the actuation of the release valve 36. Actuator 50 includes an elongated manifold 52 having an upper opening 53 in fluid communication with pressure tube 51 and a lower opening 55 in fluid communication with another pressure tube 56 extending from the pressure tank 15 and positioned so as to be pinchably closed by spring biased trigger 13. A piston 58 is movably mounted within actuator manifold 52. Piston 58 has a top seal 59 and a bottom seal 60. The actuator 50 also has a pressure cylinder 62 having a vent 61 adjacent its top end. Pressure cylinder 62 is coupled in fluid communication with pressure chamber 35 by a pressure tube 63. A piston 64, having an elongated piston rod 65, is mounted within the actuator pressure cylinder 62 for reciprocal movement therein between a low pressure position shown in FIGS. 2 and 3 and a high pressure position shown in FIG. 4. A coil spring 67 mounted about piston rod 65 biases the piston 64 towards its low pressure position. Piston rod 65 is coupled to piston 58 by an over center torsion spring 68, such as that made by Barnes Group Incorporated of Corry, Pa. under model number T038180218-R. An indexing finger 69, mounted to an end of the piston rod 65, is configured to sequentially engage and ride within each magazine L-shaped groove 33.

In use, an operator actuates the pump to pressurize a supply of air by grasping the handle 22 and reciprocating the cylinder rod 21 back and forth within the cylinder 20. Pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 52 between the top and bottom seals 59 and 60. The pressurized air then passes out of lower opening 55 and through pressure tube 51 into release valve manifold 45.

Figure 3:
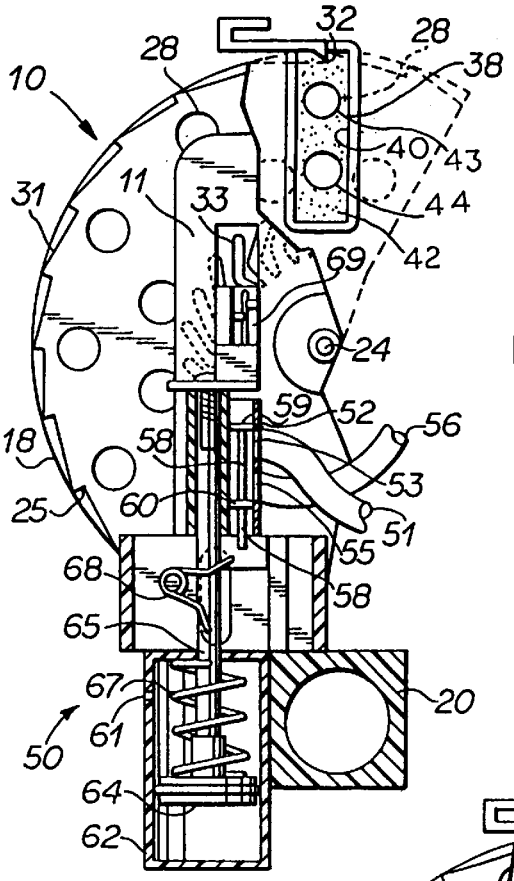
FIGS. 3–5 are a sequence of views showing a portion of the air gun of FIG. 1, which show in sequence, the actuation of an actuator which indexes a magazine and controls a release valve.
Figure 4:
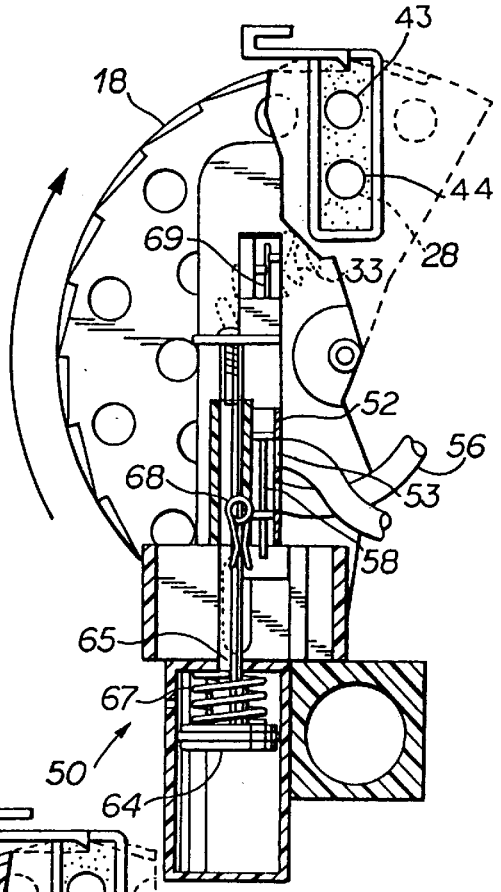
Figure 5:
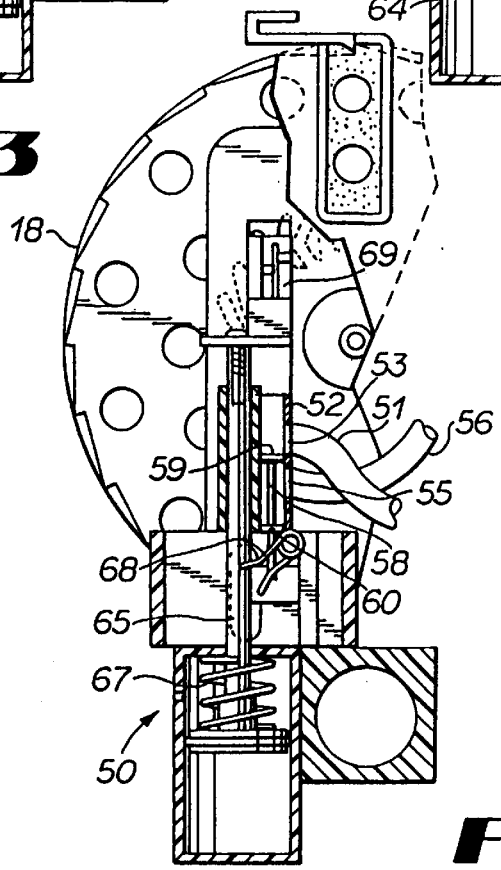
Figure 6:
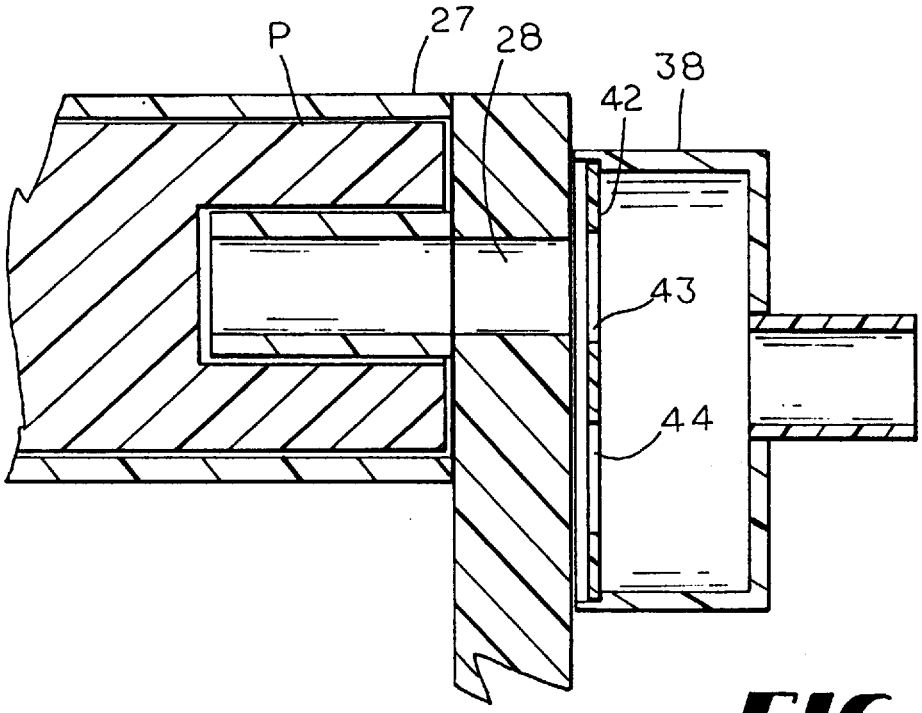
FIG. 6 is a side view, shown in cross-section, of the air pressure conduit, seal and a portion of the magazine of the rapid fire compressed air gun of FIG. 1, shown in a relaxed condition.
Figure 7:
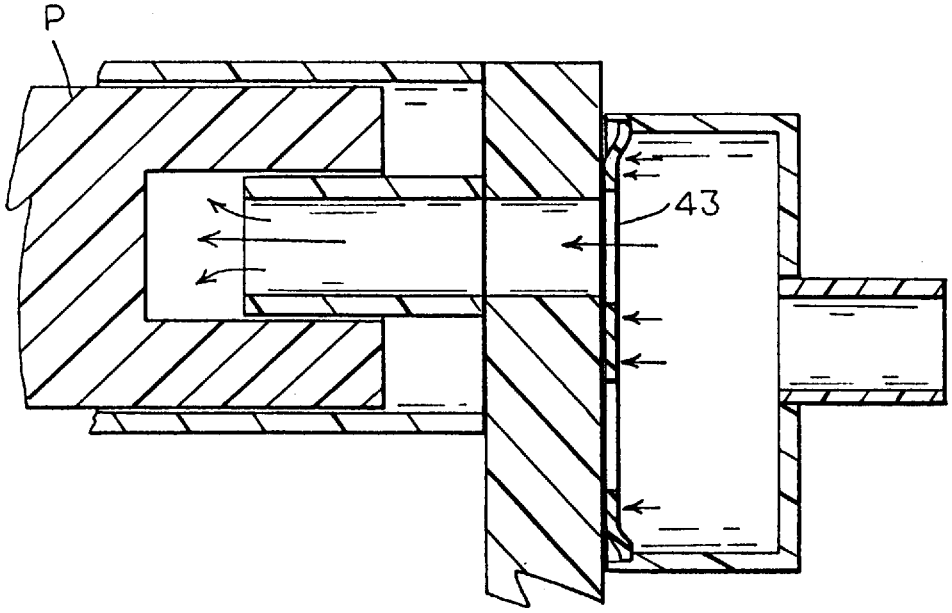
FIG. 7 is a side view, shown in cross-section, of the air pressure conduit, seal and a portion of the magazine of the rapid fire compressed air gun of FIG. 1, shown in an expanded condition.
Figure 8:
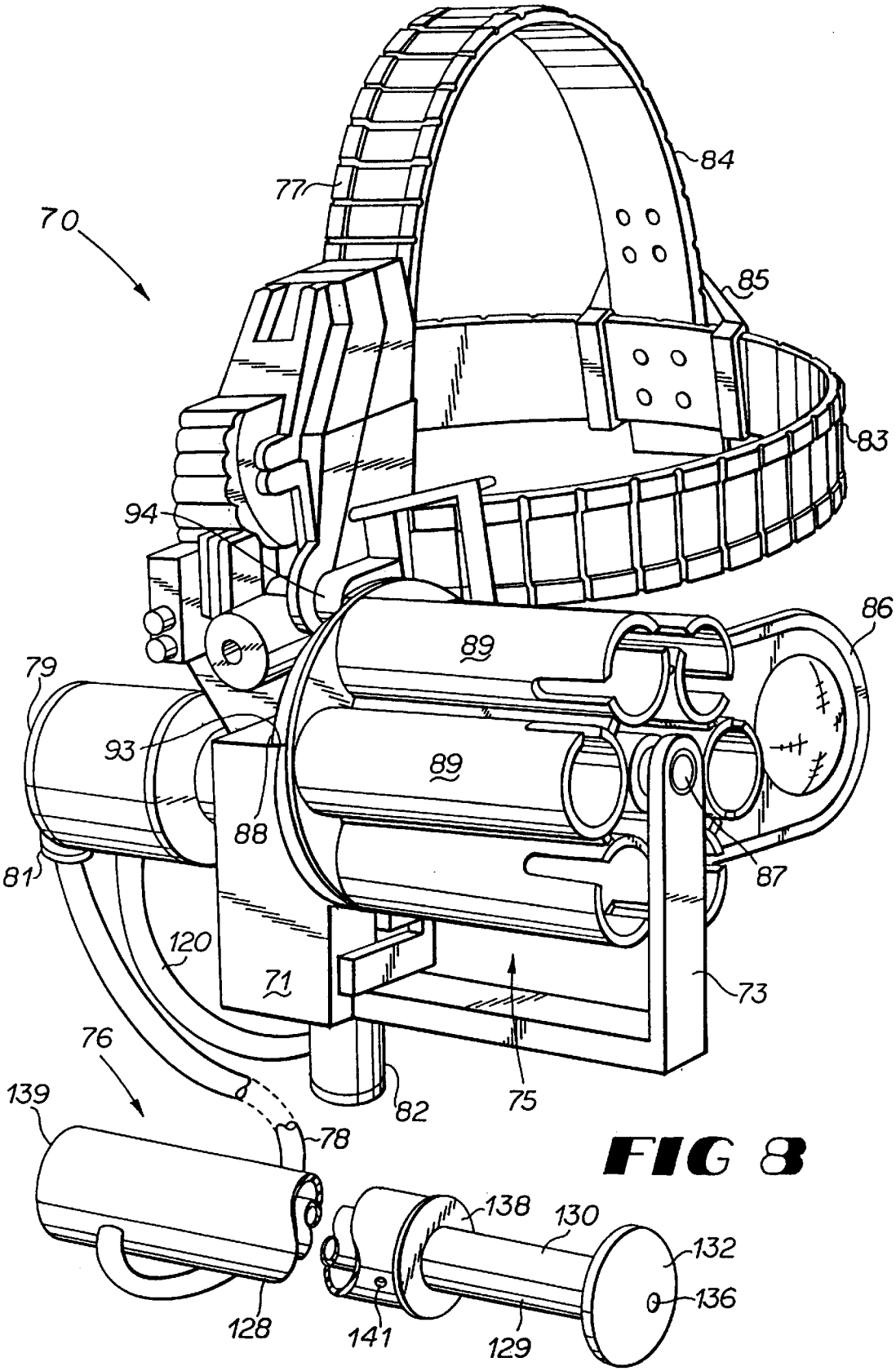
FIG. 8 is a perspective view of a rapid fire compressed air gun embodying principles of the present invention in another preferred form.

The pressurized air within the release valve manifold 45 causes the plunger 46 to move to a forward position sealing the opening 37. Pressurized air then flows between the plunger 46 and the release valve manifold 45 so as to pressurize the pressure chamber 35. A portion of the pressurized air within pressure chamber 35 passes through pressure tube 63 into the actuator pressure cylinder 62. With increased pressure within pressure cylinder 62 the piston 64 is forced upwards against the biasing force of coil spring 67, i.e. the piston 64 is moved from its low pressure position shown in FIG. 3 to its high pressure position shown in FIG. 4. As shown in FIG. 4, upward movement of the piston rod 65 causes compression of torsion spring 68 and the finger 69 to ride up within a mounting plate groove 33 thereby causing clockwise rotation of the magazine 18. All references herein to downward and upward directions is for purposes of clarity in reference to the drawings and is not meant to indicate gravity sensitivity. Upon reaching the apex of the movement of piston rod 65 the torsion spring 68 decompresses thereby forcing piston 58 downward, as shown in FIG. 5. Downward movement of piston 58 causes the top seal 59 to be positioned between upper opening 53 and lower opening 55. This positioning of the piston 58 isolates manifold lower opening 55 to prevent escape of pressurized air from pressure tank 15. This positioning of the top seal 59 also allows pressurized air within pressure tube 51 to escape to ambience through the top of actuator manifold 52. The release of air pressure causes the plunger 46 to move to a rearward position unsealing opening 37. With the unsealing of opening 37 pressurized air within pressure chamber 35 flows through opening 37, and into the central and elongated bores 39 and 40 of sealing plate 38. The passage of compressed air into the sealing plate causes the resilient gasket 42 to bellow or expand, as shown in FIG. 7. The gasket 42 expands to an expanded configuration or position wherein its outer face is pressed into contact with the magazine mounting plate 25. This contact between the gasket and the magazine mounting plate creates a temporary, air-tight seal between the sealing plate and magazine mounting plate. The compressed air within the sealing plate provides a force upon the inner surface of the gasket which maintains the gasket in firm contact with the magazine mounting plate. This also ensures a sealing contact between the gasket about the other gasket opening which is not in alignment with a magazine mounting plate opening, which in FIGS. 6 and 7 is the lower opening 44. As such, it should be understood that the vast majority of the gasket is in temporary sealing contact with the magazine mounting plate, as opposed to prior art O-ring type seals which have only a thin sealing are in continuous contact with the magazine mounting plate.

The air then travels through either the upper opening 43 or lower opening 44, depending upon which opening is aligned with a magazine opening 28, and into the launch tube 27 through mounting plate opening 28. Pressurized air within launch tube 27 propels the projectile out of the magazine barrel 26 and through gun barrel 12. The actuation of this type of release valve is described in more detail in U.S. Pat. No. 4,159,705. As the compressed air is expelled from the sealing plate its force upon the gasket diminishes and the gasket returns to its normal, relaxed configuration, shown in FIG. 6. As such, the gasket provides a temporary seal only during the duration of actual firing and thus is not maintained in contact with the moving magazine during magazine indexing.

Upon the release of pressurized air from pressure chamber 35 the pressurized air within pressure cylinder 62 is released through pressure tube 63 back into pressure chamber 35. The release of air from pressure cylinder 62 causes the piston 64 be spring biased by coil spring 67 back downward to its low pressure position. The downward movement of piston 64 retracts the indexing finger 69 from within a mounting plate groove 33 and positions the finger in register with the following mounting plate groove 33. The low pressure positioning of piston 64 causes the torsion spring 68 to bias piston 58 upwards to its initial position with the top and bottom seals 59 and 60 straddling upper and lower openings 53 and 55, as shown in FIG. 3. This repositioning of piston 58 once again causes pressurized air within pressure tank 15 to flow through pressure tube 56 into actuator manifold 52, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 67 and 68, i.e. the release valve is automatically actuated by actuator 50 and the indexing of magazine 18 continues so long as the trigger is pulled open and the pressure tank contains pressurized air above a level to overcome springs 67 and 68. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 50. Operated in such a manner the gun will index the magazine and fire a projectile with each actuation of the trigger, again, so long as the pressure tank contains air pressurized above the minimal level and the trigger is quickly released.

It should be noted that pawl 32 engages teeth 31 to prevent rotation of the magazine in a direction opposite to its indexing direction, i.e. to prevent counterclockwise rotation in FIG. 3. This prevents the firing of pressurized air into a just emptied barrel and damage to the indexing finger. It should also be noted that since the pneumatic system is closed, once the gun is initially pressurized it is maintained under at least the minimal pressure level. Thus, the gun has the capability of firing projectiles in a rapid sequence of shots one after another. Yet, the gun may also fire a sequence of single shots without having to be pumped between each successive shot.

Referring next to FIGS. 8–11, a compressed air gun 70 in another preferred form is shown. Here, the air gun 70 has a housing 71 having a support plate 72 and an L-shaped support arm 73, a magazine 75 rotationally mounted to the housing 71, a remote manual hand air pump 76, and a harness 77 secured to housing 71 and configured to be supported upon the head of a person. The gun 70 has a pressure chamber 79 adapted to receive and store a supply of air at elevated pressure levels and a pressure actuatable release valve 80 mounted within the pressure chamber 79. A control valve 81 is mounted in fluid communication with release valve 80 and is coupled in fluid communication with pump 76 by a pressure tube 78 extending therebetween. Pressure chamber 79 is pneumatically coupled to a pneumatic indexer 82 which in turn is coupled to magazine 75 for rotational movement thereof.

The head harness 77 has a generally circular base strap 83 and a inverted U-shaped, adjustable top strap 84 secured to the base strap 83 by a buckle 85. The head harness 77 also has a clear eye sight 86 configured to be positioned over the eye of a person. The top strap 84 and base strap 83 may be made of a soft, flexible plastic which can conform to the person's head.

Figure 11:
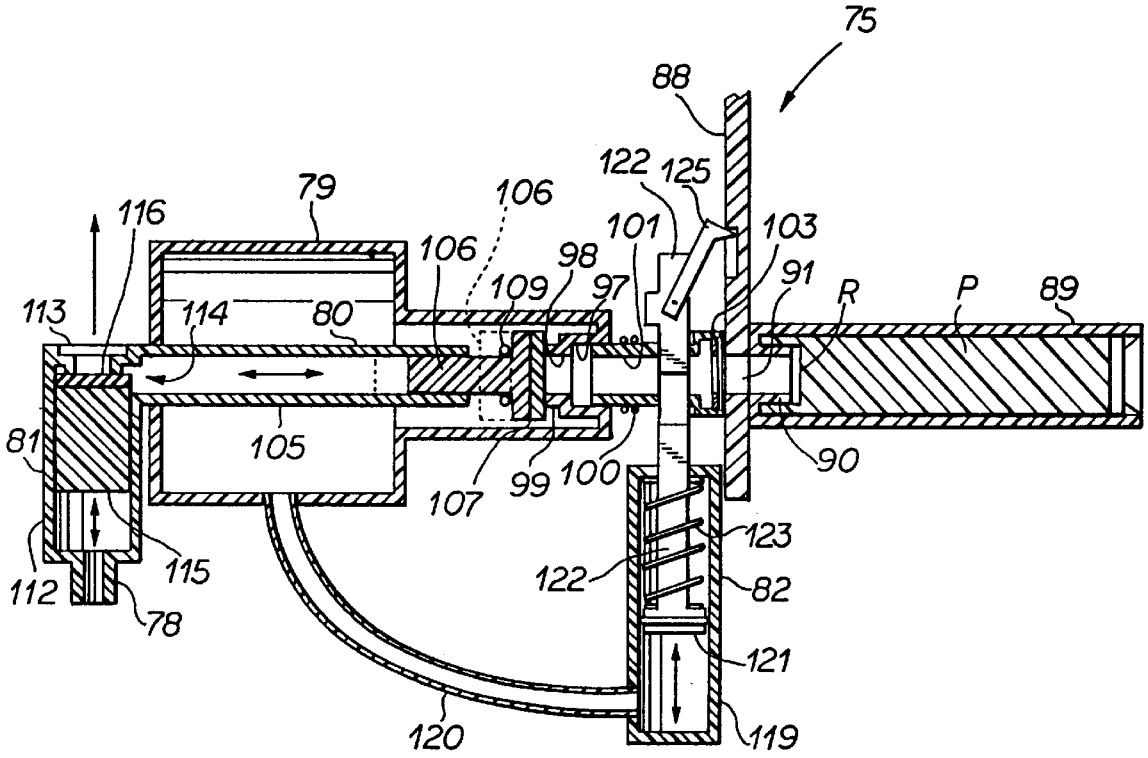
FIG. 11 is a side view, shown in partial cross-section, of interior components of the air gun of FIG. 8 and a projectile positioned within the barrel of the gun.

The magazine 75 has a central pivot rod 87 fixedly mounted to a disk-shaped mounting plate 88 and an annular array of projectile barrels or launch tubes 89 extending from the mounting plate 88 in a generally concentric circle about pivot rod 87. It should be understood that the mounting plate 88 actually comprises a portion of the launch tubes, as such the term launch tube includes a portion of the mounting plate 88. Pivot rod 87 is rotationally mounted at one end to support arm 73 and rotationally mounted at its opposite end to support plate 72. Each barrel 89 has a launch tube 90 therein aligned with an opening 91 which extends through the mounting plate 88. The interior diameter of barrel 89 is configured to releasably hold a projectile P with the launch tube 90 configured to be received within a recess R in the rear of the projectile. The magazine is shown in FIG. 11 as having only one barrel 89 for clarity of explanation. Mounting plate 88 has series of peripheral notches 93 each of which is aligned with a barrel 89. The notches 93 are configured to cooperate with a pawl 94 extending from the housing 71. Mounting plate 88 also has an annular array of L-shaped grooves 95 oriented about pivot rod 87 which are equal in number to the number of magazine barrels 89.

The pressure chamber 79 has a recess 97 having an air exit opening 98 therein defined by an inwardly extending annular flange 99. A spring biased sealing plate 100 is mounted within recess 97. The annular flange 99, the spring biased sealing plate 100 or the combination thereof may be considered a conduit. Again, an elongated conduit may be used should the pressure chamber be mounted distally from the magazine. The sealing plate 100 has a central bore 101 configured to overlay the mounting plate openings 91 of the magazine. It should be noted that the mounting plate openings 91 are positioned so that the sealing plate bore 101 overlaps only one opening 91 at a time. A resilient gasket 103 is mounted to the sealing plate 100 to ensure sealing engagement with the mounting plate 88. The resilient gasket 103 has an opening 104 therethrough generally alignable with the magazine mounting plate openings 91. The release valve 80 has a cylindrical manifold 105 and a cylindrical plunger 106 slidably mounted within the manifold 105. Plunger 106 has a gasket 107 to ensure sealing engagement of the plunger 106 about opening 98 with the plunger in a sealing position shown in FIG. 11, and a O-ring type seal 109 to ensure sealing engagement of the plunger 106 against manifold flange 99 with the plunger in a released position shown in phantom lines in FIG. 11.

The control valve 81 has an elongated cylindrical manifold 112 having a top vent opening 113 to ambience, a side opening 114 in fluid communication with release valve manifold 105, and a cylindrical plunger 115 slidably mounted within manifold 112. Plunger 115 has a gasket 116 to ensure sealing engagement of the plunger about vent opening 113 with the plunger in a pressurized position shown in FIGS. 9 and 11.

The indexer 82 has a pressure cylinder 119 coupled in fluid communication with pressure chamber 79 by a pressure tube 120. A piston 121, having an elongated piston rod 122, is mounted within the indexer pressure cylinder 119 for reciprocal movement therein between a low pressure position shown in FIG. 10 and a high pressure position shown in FIGS. 9 and 11. A coil spring 123 is mounted about piston rod 122 so as to bias the piston 121 towards its low pressure position. A spring biased indexing finger 125 is pivotably mounted to piston rod 125. Indexing finger 125 is configured to sequentially engage and ride within each magazine groove 95 as the piston rod is moved upward and to disengage the groove as the piston rod is moved downward. All references herein to downward and upward directions is for purposes of clarity in reference to the drawings and is not meant to indicate gravity sensitivity.

The air pump 76 includes an elongated cylinder 128 and a plunger 129 telescopically mounted for reciprocal movement within the cylinder 128. Plunger 129 has a tubular shaft 130 with an enlarged sealing end 131 and a handle 132 opposite the sealing end 131. Sealing end 131 has an O-ring type seal 133 with an opening 134 therethrough, and a conventional check valve 135 mounted within opening 134. Check valve 135 is oriented to allow air to pass from the interior of cylinder 128 through opening 134 into the interior of shaft 130 and to prevent air from passing through opening 134 in the opposite direction. Handle 132 has a vent 136 therethrough which allows air to pass from ambience into the interior of shaft 130.

Pump cylinder 128 has an open end 138 through which plunger 129 extends and a closed end 139. The pump cylinder 128 also has a port 140 in fluid communication with pressure tube 78 and a vent 141 adjacent open end 138 which is open to ambience. Port 140 is spaced from closed end 139 so as to allow seal 133 of plunger 129 to be moved past the port 140 to a position closely adjacent to the closed end 139, as shown in FIG. 10.

In use, a person dons the gun by securing the head harness 77 to his head with the magazine 75 to one side. The person then actuates the pump 76 by grasping the pump handle 132 and forcing the pump plunger 129 through cylinder 128 towards port 140 thereby pressurizing air within the cylinder. Thus, the plunger 129 is moved from a first position shown in phantom lines in FIG. 9 to generally a second position shown in FIG. 9. The pressurized air passes through port 140 into pressure tube 78 where it then passes through control valve 81. The increase in air pressure within the control valve manifold 112 forces the control valve plunger 115 to move to an upper, pressurized position sealing vent opening 113, as shown in FIG. 11. The pressurized air then passes about plunger 115 and through side opening 114 into the release valve manifold 105. The increase in air pressure within the release valve manifold 105 forces the control valve plunger 106 to move to a forward, pressurized position sealing opening 98, as shown in FIG. 11. The pressurized air then flows between the release valve plunger 106 and the release valve manifold 105 into pressure chamber 79.

A portion of the pressurized air within pressure chamber 79 passes through pressure tube 120 into the indexer pressure cylinder 119. With increased pressure within pressure cylinder 119 the indexer piston 121 is forced upwards against the biasing force of coil spring 123, i.e. the indexer piston 121 is moved from its low pressure position shown in FIG. 10 to its high pressure position shown in FIGS. 9 and 11. As shown in FIG. 11, upward movement of the piston rod 122 causes the finger 125 to ride up within a mounting plate groove 95 to cause counter-clockwise rotation of the magazine 75 as indicated by arrows in FIGS. 9 and 10.

Figure 10:
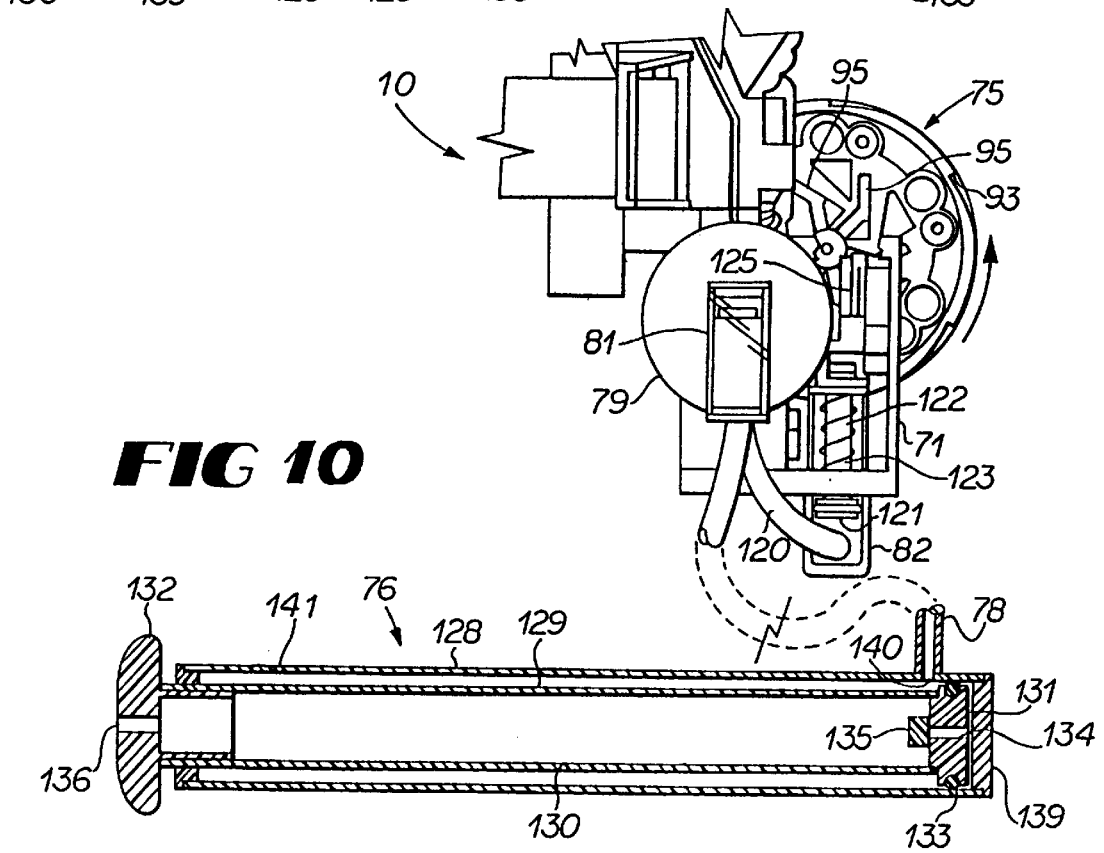
FIG. 10 is a rear view of portions of the air gun of FIG. 8 with the pump shown in side view for clarity of explanation.
Figure 12:
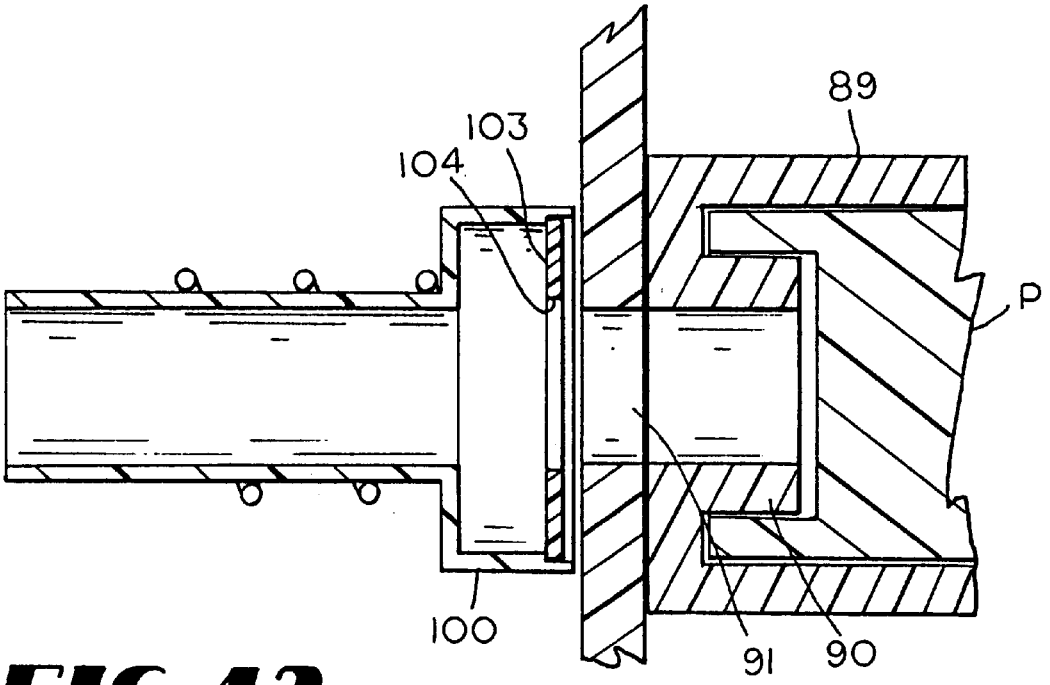
FIG. 12 is a side view, shown in cross-section, of the air pressure conduit, seal and a portion of the magazine of the rapid fire compressed air gun of FIG. 8, shown in a relaxed condition.
Figure 13:
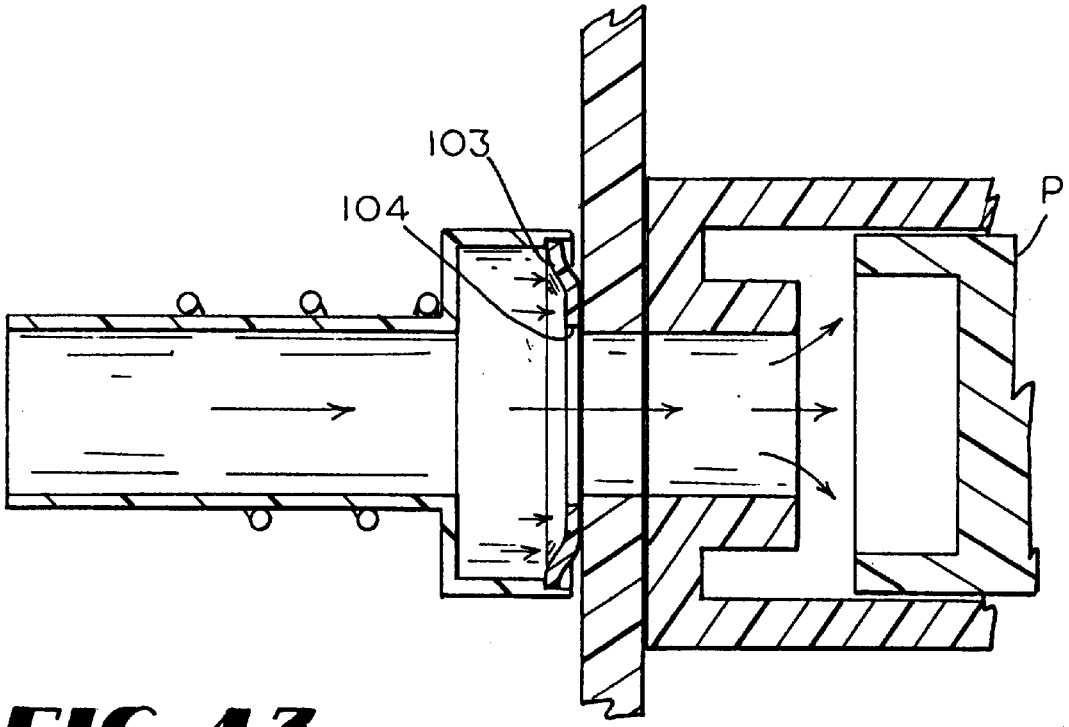
FIG. 13 is a side view, shown in cross-section, of the air pressure conduit, seal and a portion of the magazine of the rapid fire compressed air gun of FIG. 8, shown in an expanded condition.

With continued movement of the pump plunger 129 within pump cylinder 128 the seal 133 passes pump cylinder port 140, as shown in FIG. 10. With the plunger seal 133 in this position pressurized air within pressure tube 78 is released back into pump cylinder 128 behind seal 133 and then to ambience through vent 141. The reentry of pressurized air into the pump cylinder 128 from pressure tube 78 causes the control valve plunger 115 to move to a downward position unsealing vent opening 113, as shown in FIG. 10. Thus, the decrease in air pressure within the pressure tube 78 and control valve manifold 112 triggers the actuation of control valve 81 to its open configuration. The actuation of the control valve to its open, downward position causes a release of pressurized air from within release valve manifold 105 through the control valve side opening 113 and then through vent opening 113 to ambience. This decrease in pressure causes release valve plunger 106 to move to a rearward position unsealing opening 98, as shown in phantom lines in FIG. 11. The position of the plunger 106 also causes and the O-ring to abut manifold 105 to seal the path between the manifold 105 and plunger 106. With the unsealing of opening 98 pressurized air within pressure chamber 79 rapidly flows through opening 98 and into the sealing plate bore 101. The pressurized air within the sealing plate causes gasket 103 to expand from its relaxed configuration, as shown in FIG. 12, to its expanded configuration, as shown in FIG. 13. With the gasket in its expanded configuration, the outer surface is forced against the magazine mounting plate, thus creating an air-tight seal between the sealing plate and the magazine. The pressurized air places a force upon the inner surface of the gasket which temporarily maintains a large portion of the outer surface area of the gasket upon the magazine. This large surface area ensures the sealing capabilities of the gasket. The air then passes through magazine mounting plate opening 91, and into launch tube 90 in register with the sealing plate 100 where it propels the projectile P from barrel 89. Operation of this type of release valve is described in more detail in U.S. Pat. No. 4,159,705. The release of pressurized air causes gasket 103 to return to its relaxed configuration separated from the magazine, so that the rotation of the magazine does not cause wear upon the gasket.

Upon the release of pressurized air from pressure chamber 79 the pressurized air within indexer pressure cylinder 119 is conveyed through pressure tube 120 back into pressure chamber 79. This release of pressurized air from indexer pressure cylinder 119 causes the indexer piston 121 to be spring biased by coil spring 123 back downward to its low pressure position. The downward movement of piston 121 pivotally retracts the indexing finger 125 from mounting plate groove 95 and positions the finger in register with the following mounting plate groove.

The pump plunger 129 may then be manually drawn back to its initial position to pressurize and fire the gun again. The drawing back of the pump plunger 129 does not create a vacuum within pump cylinder 128 since replenishment air may be drawn through vent 136 into the plunger handle 132, through the interior of shaft 130, and through check valve 135 into cylinder 128. Air between the pump cylinder 128 and the plunger 129 behind seal 134 is expelled from cylinder 128 through vent 141.

Figure 9:
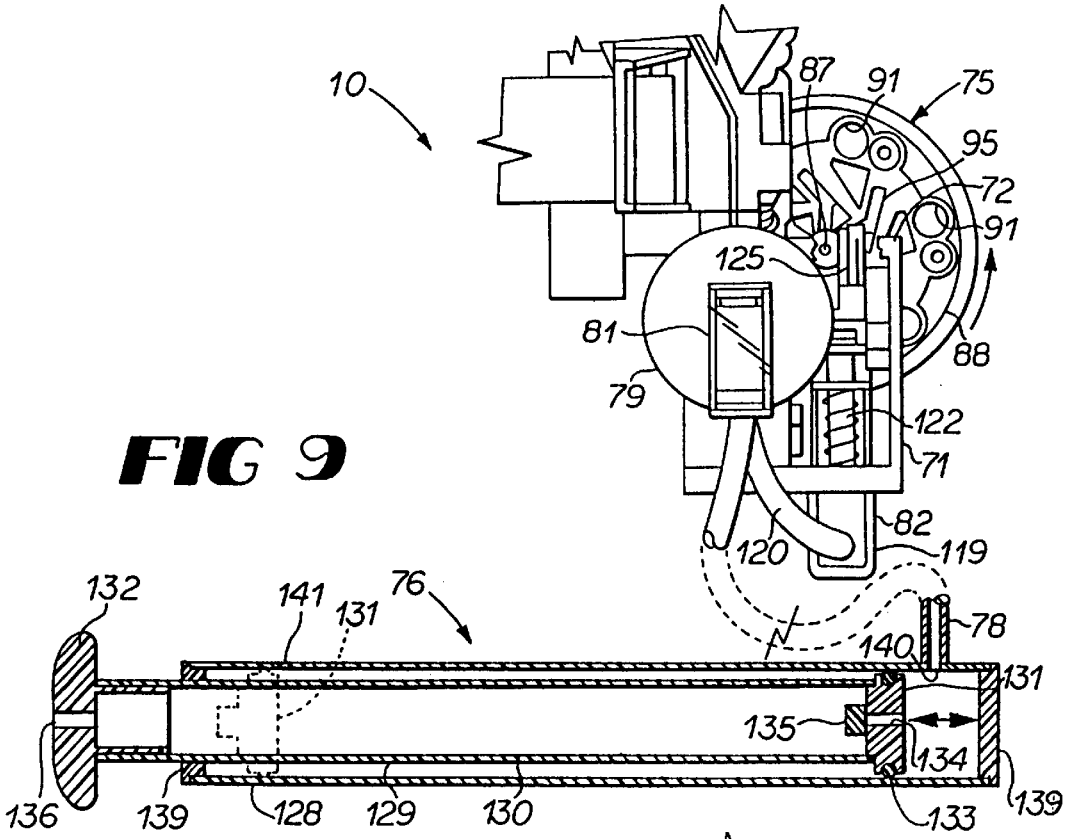
FIG. 9 is a rear view of portions of the air gun of FIG. 8 with the pump shown in side view for clarity of explanation.

It should be noted that pawl 94 engages notches 93 to prevent rotation of the magazine 75 in a direction opposite to its indexing direction, i.e. to prevent clockwise rotation of the magazine with reference to FIGS. 9 and 10. This prevents the firing of pressurized air into a previously emptied barrel and damage to the indexing finger 125.

As an alternative, gun 70 may also be constructed without control valve 81. The need for the control valve is dependent upon the length and interior diameter of pressure tube 78, i.e. the volume of air contained within the pressure tube. For a pressure tube 78 having a small interior volume the release of air therefrom causes rapid actuation of release valve 80. Conversely, with a pressure tube 78 containing a large volume of air therein the release of air therefrom may be inadequate to actuate the release valve properly. Thus, with pressure tubes having a large volume therein a control valve 81 is coupled to the release valve 80 to ensure rapid decompression within release valve manifold 105 to actuate the release valve. The gun may also be constructed without the inner launch tube 90 within the barrel 89. Here, the pressurized air expelled from pressure chamber 79 is directed into barrel 89 behind the projectile. This design however is not preferred as it does not concentrate the burst of pressurized air for optimal efficiency and performance. Lastly, it should be understood that the magazine and indexer of FIGS. 8–11 may also be adapted to a hand held gun of conventional design.

With the air gun of this construction a child may aim the gun simply by facing the intended target and manually actuating the hand pump. Because of the elongated, flexible pressure tube 78 the pump may be manipulated substantially independently of and without effecting the air of the launch tube. Also, the child may fire several shots sequentially without having to reload between each successive shot.

It should be understood that the just described construction of the gun is not meant to be limited to head mounted guns. The operational components, especially the resilient gasket, may be used in most types of compressed air guns having movable magazines regardless of whether it is incorporated into a head mounted gun or a conventional hand held gun.

It should also be understood that the sealing plates may be coupled to an elongated tube or conduit extending from the pressure chambers rather than being coupled directly to the pressure chamber. Also, it should be understood that the resilient gasket may be mounted to the end of a fixed conduit, rather than the end of the moveable sealing plate. However, the moveable sealing plate is preferred as it better serves in maintaining a selected distance between the gasket and the magazine.

It should also be understood that other types of triggers may be used, such as conventional mechanical linkages which forcibly move the release valve plunger. Also, other types of indexers, such as conventional mechanical indexers, may be used in conjunction with the resilient gasket. Additionally, it should be understood that the resilient gasket may be used with guns which may not include an air pump but which may use only a pressure tank, and may also be used with any conventional type of air pump.

As used herein, the term launch tube may include a tube which is inserted into a dart or other projectile, similar to launch tube 27, or a tube in which the dart is positioned for firing, similar to barrel 26, or a combination thereof. Also, the launch tube may include a portion of the adjoining mounting plate in order to form a complete projectile receptacle.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

I claim:

1. A compressed air toy gun for firing projectiles comprising:

a launch tube adapted to hold a projectile, said launch tube having an end wall and an air opening extending through said end wall;

an air pump adapted to compress air;

a conduit in fluid communication with said air pump and said launch tube, said conduit having an exit end positioned adjacent said launch tube end wall; and an elastic seal mounted to said exit end of said conduit, said seal having an opening therethrough generally aligned with said air opening of said launch tube end wall and having an outer surface facing said launch tube end wall, said seal being adapted to be stretched between a relaxed position generally separated from said launch tube end wall and a stretched position wherein said elastic seal is bellowed to a position wherein said outer surface is in contact with said launch tube end wall about said end wall air opening.

2. The compressed air toy gun of claim 1 wherein said conduit has a moveable portion which includes said exit end, and spring biasing means for biasing said moveable portion towards said launch tube.

3. The compressed air toy gun of claim 1 further comprising a movably magazine having a plurality of said launch tubes.

4. The compressed air toy gun of claim 3 wherein said conduit has a moveable portion which includes said exit end, and spring biasing means for biasing said moveable portion towards said launch tube.

5. The compressed air toy gun of claim 1 further comprising a pressure tank in fluid communication with said conduit.

6. The compressed air toy gun of claim 5 further comprising a movably magazine having a plurality of said launch tubes.

7. The compressed air toy gun of claim 6 wherein said conduit has a moveable portion which includes said exit end, and spring biasing means for biasing said moveable portion towards said launch tube.

8. The compressed air toy gun of claim 3 where said seal has a first opening therethrough and a second opening therethrough, and wherein said magazine has at least one launch tube opening alignable with said first opening and at least one launch tube opening alignable with said second opening, whereby one opening is aligned with the opening of a launch tube with the other opening not aligned with the other launch tube opening, and whereby pressurized air may sealably pass through a seal opening aligned with a launch tube opening while simultaneously the seal prevents air from passing through the other seal opening and between the conduit and magazine.

9. The compressed air toy gun of claim 8 wherein said conduit has a moveable portion which includes said exit end, and spring biasing means for biasing said moveable portion towards said launch tube.

10. The compressed air toy gun of claim 8 further comprising a pressure tank in fluid communication with said conduit.

11. A compressed air toy gun for firing projectiles comprising:

a launch tube adapted to hold a projectile, said launch tube having an air entry;

pressurized air supply means for supplying a quantity of pressurized air;

a conduit in fluid communication with said pressurized air supply means and said launch tube, said conduit having an exit end positioned adjacent said launch tube entry; and temporary sealing means for temporarily creating a seal between said conduit and said launch tube as air from said pressurized air supply means is conveyed through said conduit means into said launch tube, said temporary sealing means having an elastic member mounted to said exit end of said conduit, said elastic member having an opening therethrough generally aligned with said launch tube entry, said elastic member being adapted to be stretched between a relaxed position generally separated from said launch tube entry and a stretched position wherein said elastic member is bellowed to a position in contact with and about said launch tube entry.

12. The compressed air toy gun of claim 11 wherein said conduit has a moveable portion which includes said exit end, and spring biasing means for biasing said moveable portion towards said launch tube.

13. The compressed air toy gun of claim 11 further comprising a movably magazine having a plurality of said launch tubes.

14. The compressed air toy gun of claim 13 wherein said conduit has a moveable portion which includes said exit end, and spring biasing means for biasing said moveable portion towards said launch tube.

15. The compressed air toy gun of claim 11 further comprising a pressure tank in fluid communication with said conduit.

16. The compressed air toy gun of claim 15 further comprising a movably magazine having a plurality of said launch tubes.

17. The compressed air toy gun of claim 16 wherein said conduit has a moveable portion which includes said exit end, and spring biasing means for biasing said moveable portion towards said launch tube.

18. The compressed air toy gun of claim 13 where said elastic member has a second opening therethrough and wherein said magazine has at least one launch tube entry alignable with said opening and at least one launch tube entry alignable with said second opening, whereby one opening is aligned with the entry of a launch tube with the other opening not aligned with a launch tube entry, whereby pressurized air may sealably pass through a elastic member opening aligned with a launch tube entry while simultaneously the elastic member prevents air from passing through the other elastic member opening and between the conduit and magazine.

19. The compressed air toy gun of claim 18 wherein said conduit has a moveable portion which includes said exit end, and spring biasing means for biasing said moveable portion towards said launch tube.

20. The compressed air toy gun of claim 18 further comprising a pressure tank in fluid communication with said conduit.

21. A compressed air toy gun for firing projectiles comprising:

a launch tube adapted to hold a projectile, said launch tube having an air opening therethrough;

a source of pressured air;

a conduit in fluid communication with said source of pressurized air and said launch tube, said conduit having an exit end positioned adjacent said launch tube air opening; and an elastic seal mounted to said exit end of said conduit, said seal having an opening therethrough generally aligned with said air opening of said launch tube, said seal being adapted to be stretched between a relaxed position generally separated from said launch tube and a stretched position wherein said seal is bellowed to a position in contact with said launch tube about said air opening.

22. The compressed air toy gun of claim 21 wherein said conduit has a moveable portion which includes said exit end, and spring biasing means for biasing said moveable portion towards said launch tube.

23. The compressed air toy gun of claim 21 further comprising a movably magazine having a plurality of said launch tubes.

24. The compressed air toy gun of claim 23 wherein said conduit has a moveable portion which includes said exit end, and spring biasing means for biasing said moveable portion towards said launch tube.

25. The compressed air toy gun of claim 21 wherein said pressurized air source in an air pump.

26. The compressed air toy gun of claim 25 wherein said pressurized air source further comprises a pressure tank.

27. The compressed air toy gun of claim 21 wherein said pressurized air source is a pressure tank.

28. The compressed air toy gun of claim 23 where said seal has a first opening therethrough and a second opening therethrough, and wherein said magazine has at least one launch tube opening alignable with said first opening and at least one launch tube opening alignable with said second opening, whereby one opening is aligned with the opening of a launch tube with the other opening not aligned with the other launch tube opening, and whereby pressurized air may sealably pass through a seal opening aligned with a launch tube opening while simultaneously the seal prevents air from passing through the other seal opening and between the conduit and magazine.

29. The compressed air toy gun of claim 28 wherein said conduit has a moveable portion which includes said exit end, and spring biasing means for biasing said moveable portion towards said launch tube.

* * * * *